US010796827B2

(12) United States Patent
Chen

(10) Patent No.: US 10,796,827 B2
(45) Date of Patent: Oct. 6, 2020

(54) CERMETS FOR MAGNETIC SENSORS

(71) Applicant: National Tsing Hua University, Hsinchu (TW)

(72) Inventor: Swe-Kai Chen, Hsinchu (TW)

(73) Assignee: NATIONAL TSING HUA UNIVERSITY, Hsinchu (TW)

( * ) Notice: Subject to any disclaimer, the term of this patent is extended or adjusted under 35 U.S.C. 154(b) by 332 days.

(21) Appl. No.: 15/996,698

(22) Filed: Jun. 4, 2018

(65) Prior Publication Data

US 2019/0180894 A1 Jun. 13, 2019

(30) Foreign Application Priority Data

Dec. 12, 2017 (TW) ..... 106143592 A

(51) Int. Cl.
*H01F 1/00* (2006.01)
*C22C 29/06* (2006.01)

(52) U.S. Cl.
CPC ..... *H01F 1/0018* (2013.01); *C22C 29/06* (2013.01); *C22C 29/067* (2013.01); *B22F 2998/10* (2013.01); *C22C 2202/02* (2013.01)

(58) Field of Classification Search
CPC ..... H01L 1/0018; C22C 29/06; C22C 29/067; C22C 2202/02
See application file for complete search history.

(56) References Cited

U.S. PATENT DOCUMENTS 3,758,662 A * 9/1973 Tobin ..... C01B 32/90 264/332
4,097,275 A * 6/1978 Horvath ..... C22C 1/056 419/15
6,372,012 B1 * 4/2002 Majagi ..... B22F 3/156 75/232

* cited by examiner

*Primary Examiner* — C Melissa Koslow
(74) *Attorney, Agent, or Firm* — Locke Lord LLP; Tim Tingkang Xia, Esq.

(57) ABSTRACT

Disclosed are cermets for magnetic sensors. The disclosed cermets for magnetic sensors may include at least six carbides and at least one refractory metal. The carbides are selected from TiC, VC, ZrC, HfC, WC, NbC and TaC, the refractory metal is tungsten, the cermets for magnetic sensors operate in 100~3000 K, the magnetic precision is between 99.6~99.9%, such that the cermets for magnetic sensors are suitable for the magnetic sensors to operate at high temperatures.

6 Claims, 8 Drawing Sheets

CERMETS FOR MAGNETIC SENSORS

CROSS-REFERENCE TO RELATED APPLICATIONS

This non-provisional application claims priority under 35 U.S.C. § 119(a) on Patent Application No(s). 106143592 filed in Taiwan, R.O.C. on Dec. 12, 2017, the entirety of which is incorporated by reference herein.

BACKGROUND OF THE INVENTION

1. Field of the Invention

The disclosure is related to cermets for magnetic sensors, and more particularly to cermets for magnetic sensors which can be used for magnetic sensors in 100~3000 K.

2. Descriptions of the Related Art

Cemented carbides are composites composed of carbide and metal. The hardness of carbide is high, and so does the hardness of cemented carbide, which is beneficial in engineering. The material can be widely used in different cutting tools, mineral extractions and military parts.

Traditionally, cemented carbides are composed of a strengthening phase and a cemented phase. The strengthening phase has a high melting point, a high toughness as well as good wear resistance. Additionally, the cemented phase has a high electrical and thermal conductivity as well as a high toughness, which is the most important that the composite is not brittle. Traditional hard metals and cermet composites are mainly prepared by sintering so that the strengthening phase would remain as a solid while the cemented phase can be either a solid or a liquid), and the minute amount of the cemented phase is incorporated. However, the density of the composite is a problem in connection with the traditional sintering described above, let alone relatively complicated preparation process and excessive cost and limited operating temperature of the composite.

In addition, it is extremely difficult to operate magnetic sensors under high temperatures because the magnetic susceptibility greatly decreases. However, according to the disclosure, the magnetic susceptibility of the smelted materials is linear to temperature.

SUMMARY OF THE INVENTION

Disclosed are cermets for magnetic sensors. The composition of the cermet for magnetic sensors may include at least six carbides and at least one refractory metal. The carbides are selected from TiC, VC, ZrC, HfC, WC, NbC and TaC, the refractory metal is tungsten, the cermet for magnetic sensors may operate in 100~3000 K, and the magnetic precision is in 99.6~99.9%. Consequently, the cermets for magnetic sensors are suitable for the magnetic sensors used at high temperatures.

In one embodiment, the transition point from para-magnetism and diamagnetism of the cermet for magnetic sensors is much greater than 0 K.

In another embodiment, the carbides comprise TiC, ZrC, HfC, WC, NbC and TaC, and when the operation temperature of the cermet for magnetic sensors is higher than 2300 K, the state of the cermet for magnetic sensors transforms from para-magnetic to diamagnetic.

In another embodiment, the carbides comprise TiC, VC, ZrC, HfC, WC, NbC and TaC, and when the operation temperature of the cermet for magnetic sensors is higher than 2800 K, the cermet for magnetic sensors transforms from para-magnetic to diamagnetic.

In another embodiment, when the magnetic susceptibility of the cermet for magnetic sensors is closer to the transition point between para-magnetism and diamagnetism, the correlation of magnetic susceptibility to temperature is linear.

In another embodiment, the para-magnetic Curie point of the cermet for magnetic sensors is higher than the ferromagnetic Curie point of the cermet for magnetic sensors.

DETAILED DESCRIPTION OF THE PREFERRED EMBODIMENTS

The technical solutions, features and effects of the disclosure can be clearly described in the description of preferred embodiments with reference to the drawings.

Figure 1:
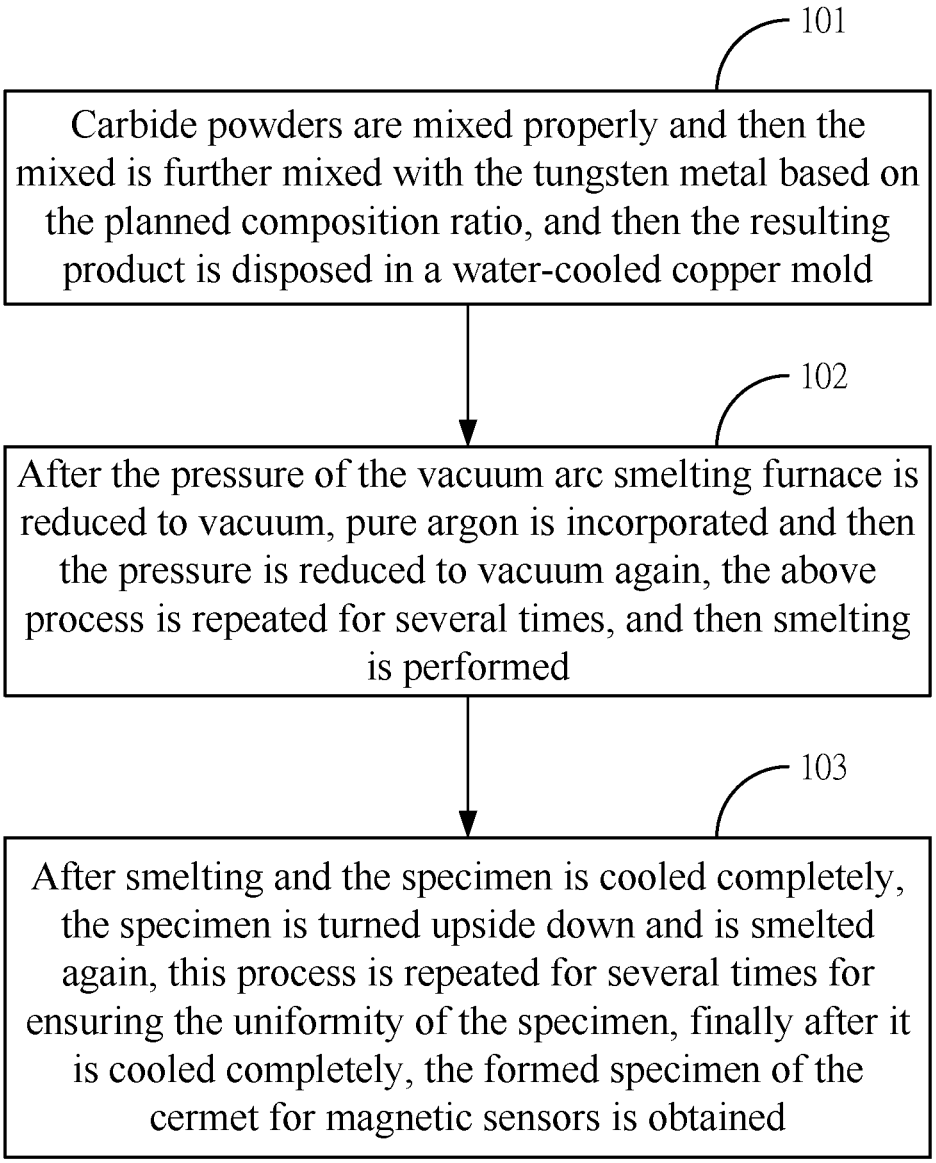
FIG. 1 is a flow chart of the process for preparing the cermet for magnetic sensors of the disclosure.

Referring to FIG. 1, the preparation is as the following:

(1) According to the disclosure, carbide powders (TiC, VC, ZrC, HfC, WC, NbC and TaC) are mixed properly and then the mixed is further mixed with the tungsten metal based on the designed composition ratio, and then the resulting product is disposed in a groove of a water-cooled copper mold of a vacuum arc smelting furnace (101);

(2) After the pressure of the vacuum arc smelting furnace is reduced to "vacuum" (the pressure of the furnace is reduced to $2.4\times10^{-2}$ torr), pure argon (Ar) is incorporated until the pressure is elevated to about 8.0 torr, and then the pressure is reduced to "vacuum" again (reduced to $2.4\times10^{-2}$ torr). The process of incorporating Ar and then reducing the pressure is called "purge". The above process is repeated for several times, and then argon is incorporated until the pressure is back to about 8.0 torr and smelting is performed (102); and (3) After smelting and after the specimen is cooled, the specimen is turned upside down and is smelted again. This process is repeated for several times for ensuring the uniformity of the specimen, finally after it is cooled completely, the pressure of the furnace is elevated to 1 atm, and the formed specimen of the cermet for magnetic sensors is obtained (103).

According to the disclosure, the correlation between magnetic susceptibility and temperature is:

$$\chi^{-1}=TC^{-1}+\chi_0^{-1}-b(T-\theta_p)^{-1}$$

Wherein $\chi$ is magnetic susceptibility, C is the Curie diamagnetic coefficient, $\chi_0$ is the Pauli paramagnetic coefficient, b is lattice diamagnetic coefficient, T is absolute temperature, and $\theta_p$ is paramagnetic Curie point.

According to the disclosure, the variation of the magnetic field is measured by superconducting quantum interference device (SUQID) under the external magnetic field of 1000 Oe. The experimental result is fitted with the correlation between magnetic susceptibility and temperature. In the disclosure, eight embodiments are disclosed, the correlation between magnetic susceptibility and temperature is solved and fitted by the software simulation results.

(1) First Embodiment (C7M1)

Figure 2A:
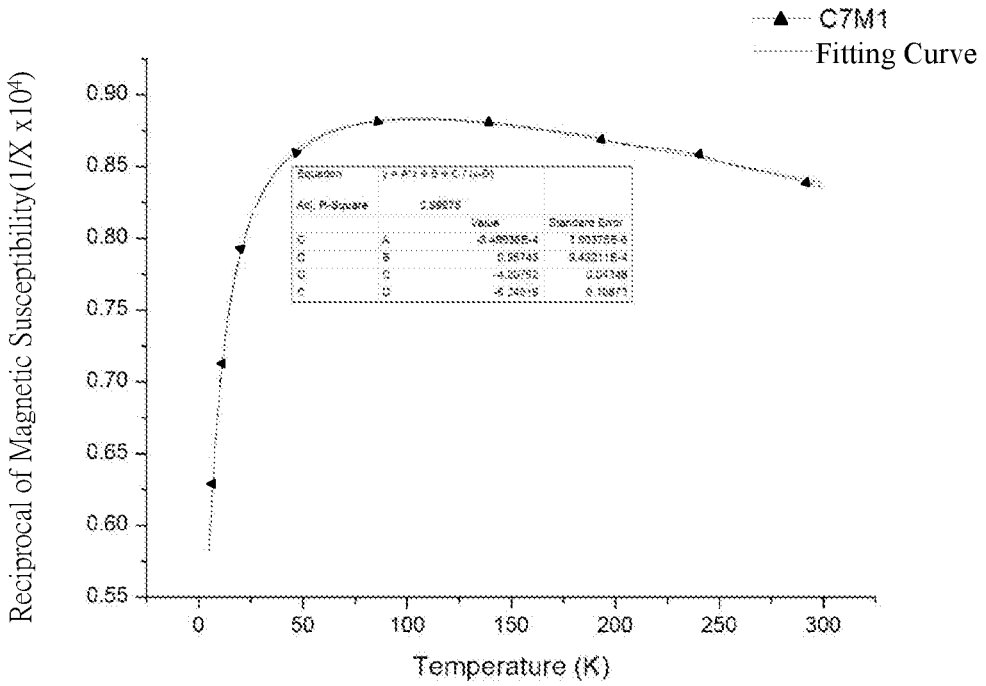
FIG. 2A is a comparison of the fitting result of the cermet for magnetic sensors according to the first embodiment of the disclosure.

The composition is $[(TiC)(ZrC)(HfC)(VC)(NbC)(TaC)(WC)]_{0.6}W_{0.4}$, wherein the carbides include TiC, VC, ZrC, HfC, WC, NbC and TaC, and the refractory metal is tungsten. As shown in FIG. 2A, the precision between the magnetic susceptibility data and the fitting curve is 99.975%.

(2) Second Embodiment (—TiC)

Figure 2B:
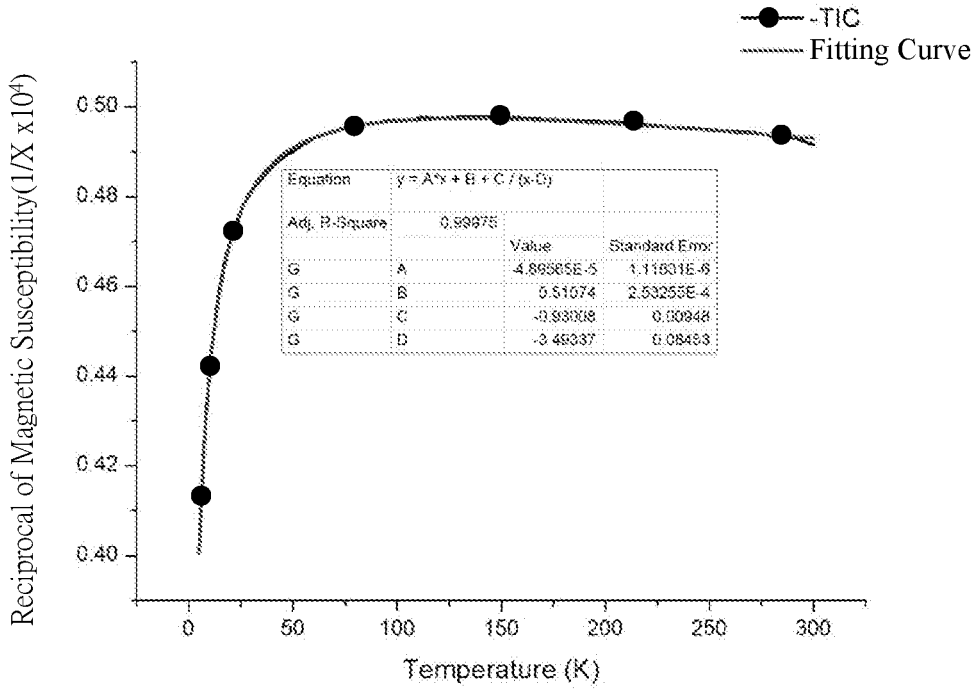
FIG. 2B is a comparison of the fitting result of the cermet for magnetic sensors according to the second embodiment of the disclosure.

The composition is $[(ZrC)(HfC)(VC)(NbC)(TaC)(WC)]_{0.6}W_{0.4}$, wherein the carbides include VC, ZrC, HfC, WC, NbC and TaC, and the refractory metal is tungsten. As shown in FIG. 2B, the precision between the magnetic susceptibility data and the fitting curve is 99.975%.

(3) Third Embodiment (—ZrC)

Figure 2C:
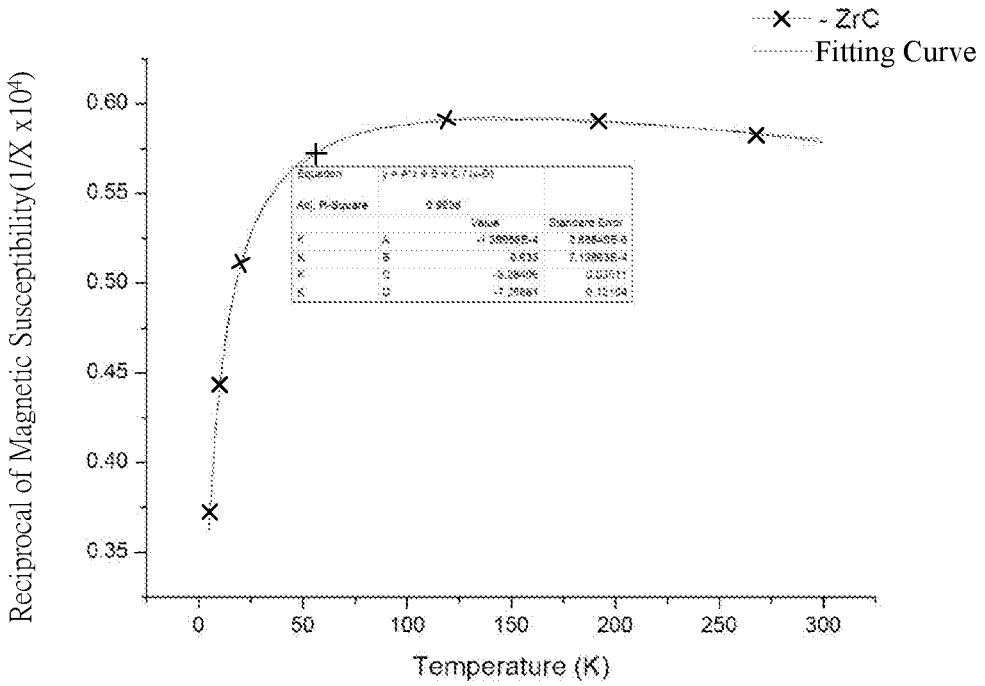
FIG. 2C is a comparison of the fitting result of the cermet for magnetic sensors according to the third embodiment of the disclosure.

The composition is $[(TiC)(HfC)(VC)(NbC)(TaC)(WC)]_{0.6}W_{0.4}$, wherein the carbides include TiC, VC, HfC, WC, NbC and TaC, and the refractory metal is tungsten. As shown in FIG. 2C, the precision between the magnetic susceptibility data and the fitting curve is 99.98%.

(4) Fourth Embodiment (—HfC)

Figure 2D:
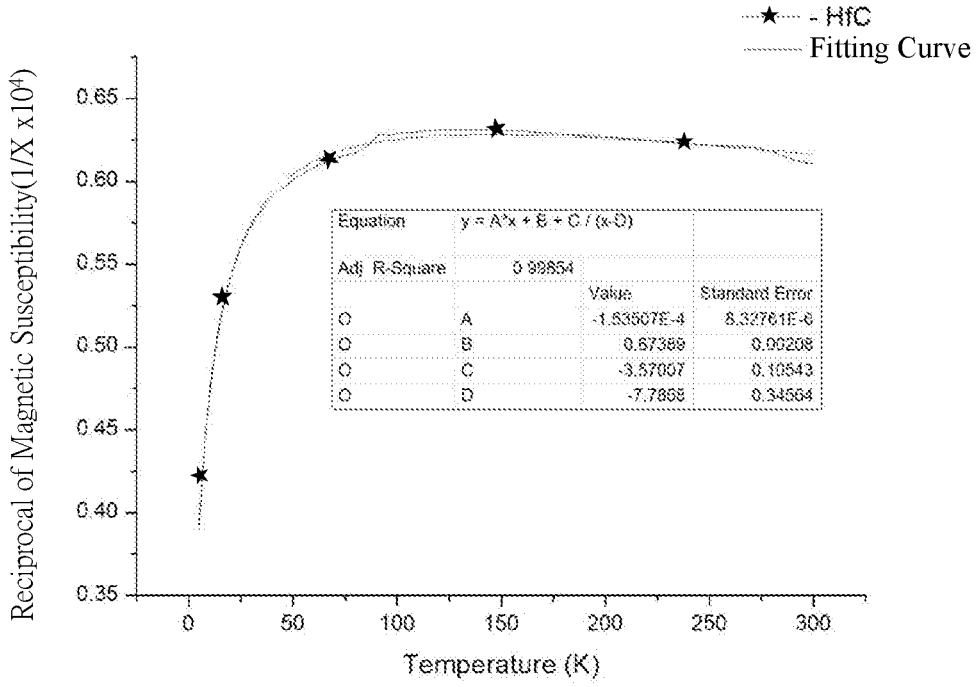
FIG. 2D is a comparison of the fitting result of the cermet for magnetic sensors according to the fourth embodiment of the disclosure.

The composition is $[(TiC)(ZrC)(VC)(NbC)(TaC)(WC)]_{0.6}W_{0.4}$, wherein the carbides include TiC, VC, ZrC, WC, NbC and TaC, and the refractory metal is tungsten. As shown in FIG. 2D, the precision between the magnetic susceptibility data and the fitting curve is 99.854%.

(5) Fifth Embodiment (—VC)

Figure 2E:
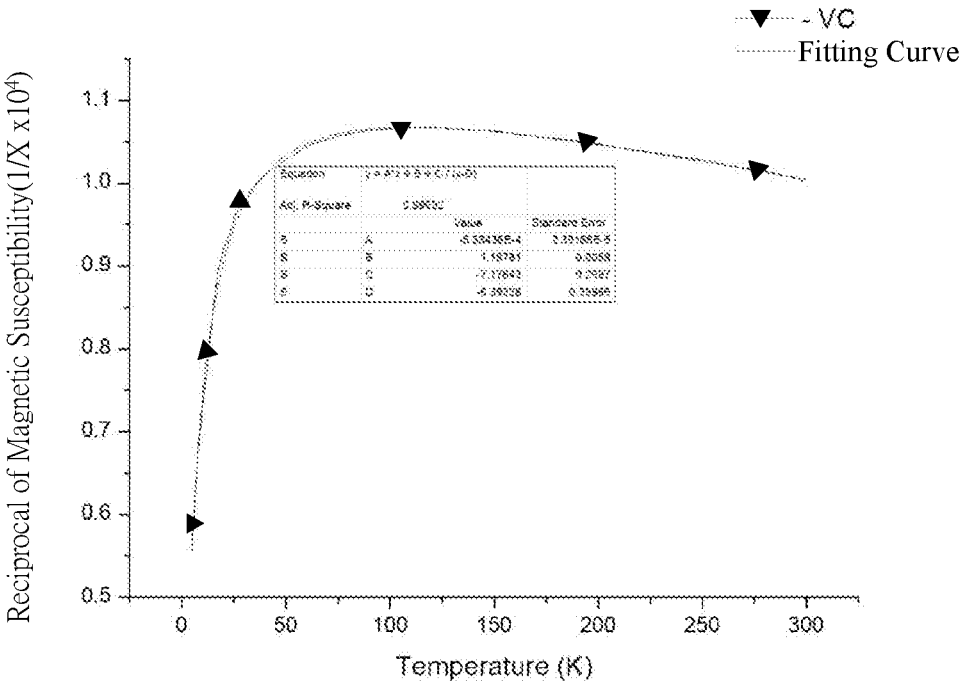
FIG. 2E is a comparison of the fitting result of the cermet for magnetic sensors according to the fifth embodiment of the disclosure.

The composition is $[(ZrC)(HfC)(VC)(NbC)(TaC)(WC)]_{0.6}W_{0.4}$, wherein the carbides include VC, ZrC, HfC, WC, NbC and TaC, and the refractory metal is tungsten. As shown in FIG. 2E, the precision between the magnetic susceptibility data and the fitting curve is 99.692%.

(6) Sixth Embodiment (—NbC)

Figure 2F:
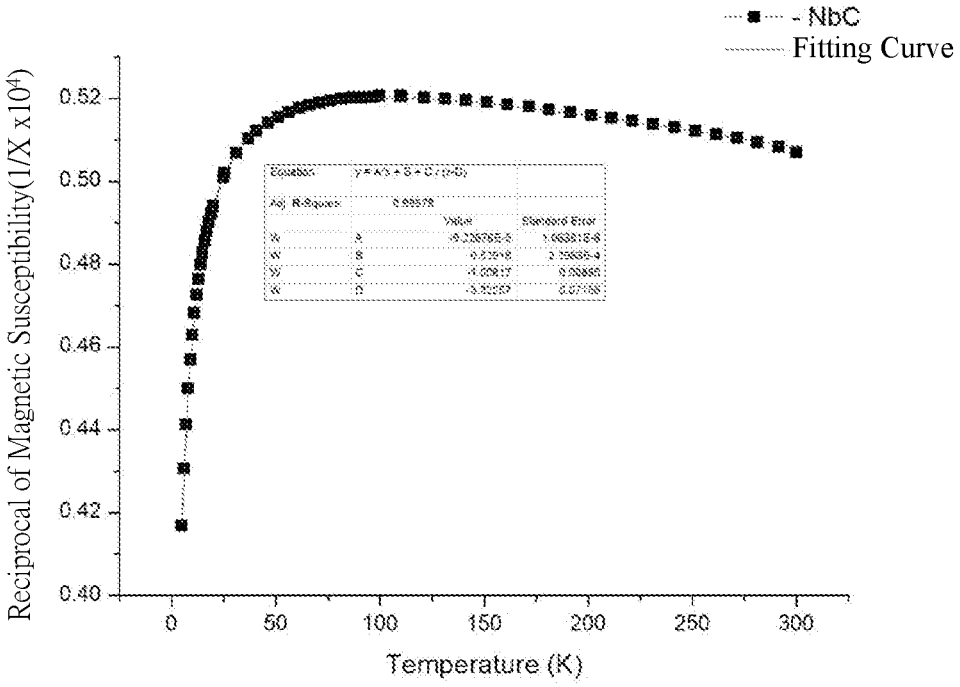
FIG. 2F is a comparison of the fitting result of the cermet for magnetic sensors according to the sixth embodiment of the disclosure.

The composition is $[(TiC)(ZrC)(HfC)(VC)(TaC)(WC)]_{0.6}W_{0.4}$ wherein the carbides include TiC, VC, ZrC, HfC, WC and TaC, and the refractory metal is tungsten. As shown in FIG. 2F, the precision between the magnetic susceptibility data and the fitting curve is 99.978%.

(7) Seventh Embodiment (—TaC)

Figure 2G:
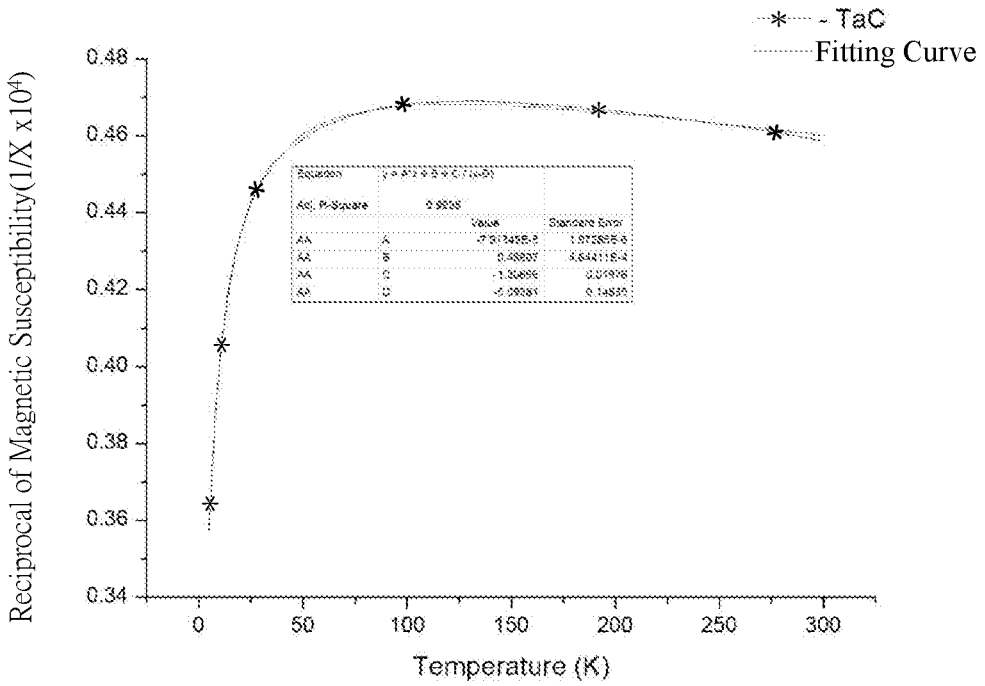
FIG. 2G is a comparison of the fitting result of the cermet for magnetic sensors according to the seventh embodiment of the disclosure.

The composition is $[(TiC)(ZrC)(HfC)(VC)(NbC)(WC)]_{0.6}W_{0.4}$, wherein the carbides include TiC, VC, ZrC, HfC, WC and NbC, and the refractory metal is tungsten. As shown in FIG. 2G the precision between the magnetic susceptibility data and the fitting curve is 99.95%.

(8) Eighth Embodiment (—TiC)

Figure 2H:
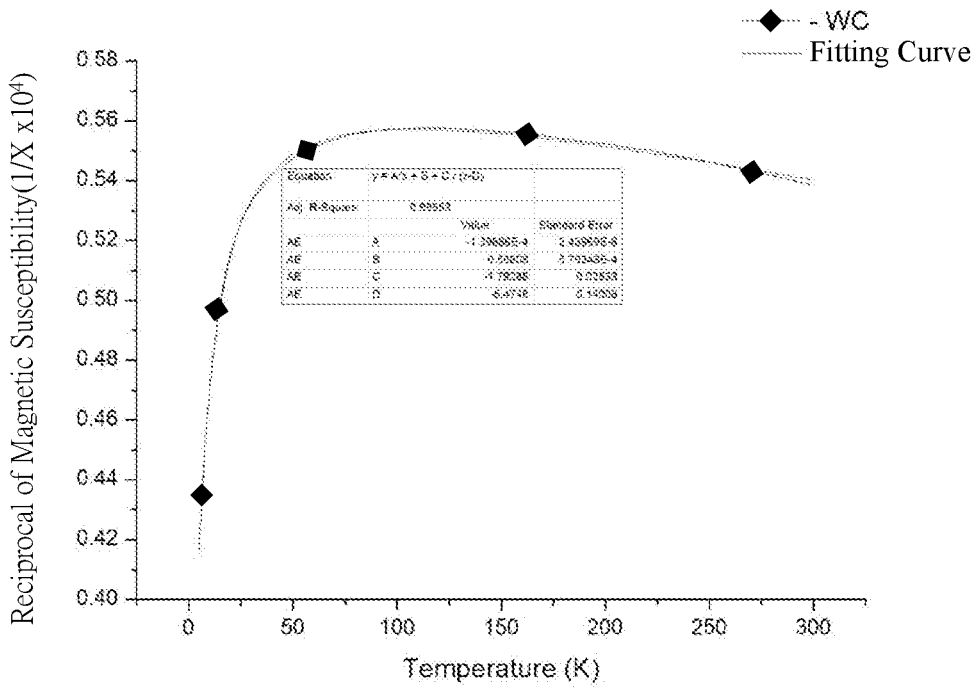
FIG. 2H is a comparison of the fitting result of the cermet for magnetic sensors according to the eighth embodiment of the disclosure.
Figure 2I:
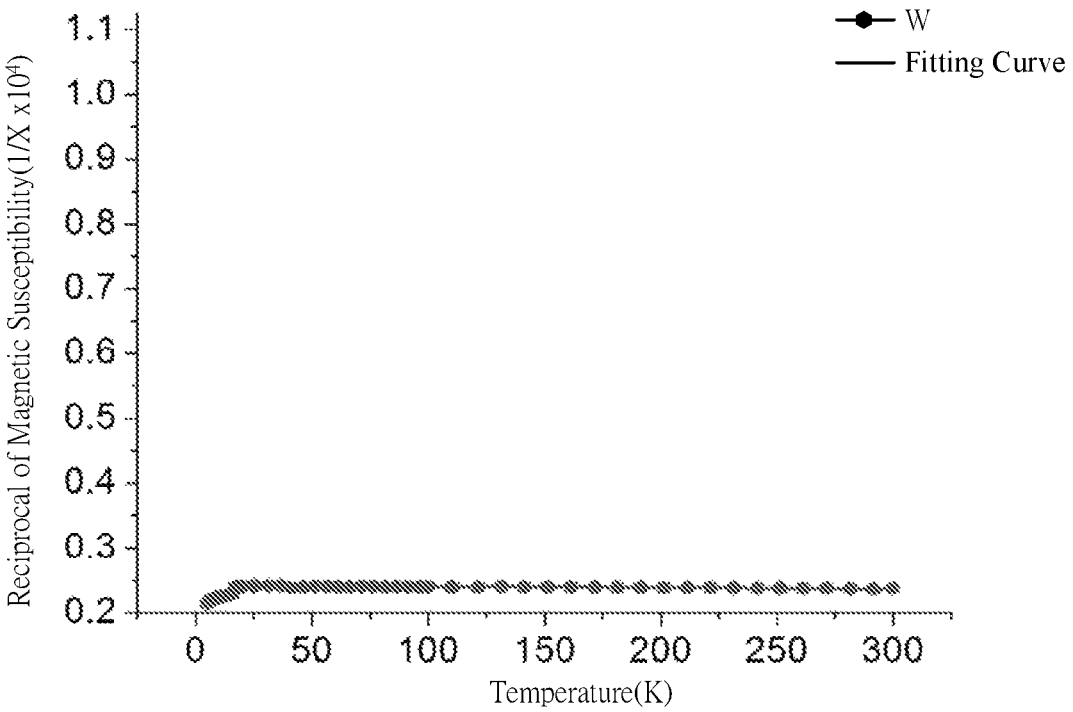
FIG. 2I is a comparison of the fitting result of the cermet for magnetic sensors according to the ninth embodiment of the disclosure.

The composition is $[(TiC)(ZrC)(HfC)(VC)(NbC)(TaC)]_{0.6}W_{0.4}$, wherein the carbides include TiC, VC, ZrC, HfC, NbC and TaC, and the refractory metal is tungsten. As shown in FIG. 2H, the precision between the magnetic susceptibility data and the fitting curve is 99.95%.

(9) Ninth Embodiment (W)

The magnetic field variation of tungsten measured is under the external magnetic field of 1000 Oe, and the precision between the magnetic susceptibility data and the fitting curve is 99.7%.

In the above embodiments, the precisions are all higher than 99%, such that it is assumed that $\chi^{-1}$ is zero and ferromagnetic Curie point $\Theta_f$ based on the correlation between magnetic susceptibility and temperature is solved. Afterwards, based on the correlation the temperature range extended is to 10000 K for studying the trend of magnetization of the composite at high temperatures. In the disclosure, the properties between para-magnetism and dimagnetism are studied (the transition point is $-C/\chi_0$, a singular point), and the descriptions are as the followings:

1. First Embodiment (C7M1)

When the cermet for magnetic sensors operate in 100~3000 K, the magnetic precision is 99.975%, and when the magnetic susceptibility is closer to the transition point (2735 K) between para-magnetism and diamagnetism, the correlation of magnetic susceptibility to temperature is linear.

2. Second Embodiment (—TiC)

When the cermet for magnetic sensors operate in 100~3000 K, as the magnetic susceptibility is closer to the transition point (10443 K) between para-magnetism and diamagnetism, the correlation of magnetic susceptibility to temperature is linear.

3. Third Embodiment (—ZrC)

When the cermet for magnetic sensors operate in 100~3000 K, as the magnetic susceptibility is closer to the transition point (4521 K) between para-magnetism and diamagnetism, the correlation of magnetic susceptibility to temperature is linear.

4. Fourth Embodiment (—HfC)

When the cermet for magnetic sensors operate in 100~3000 K, as the magnetic susceptibility is closer to the transition point (4351 K) between para-magnetism and diamagnetism, the correlation of magnetic susceptibility to temperature is linear.

5. Fifth Embodiment (—VC)

When the cermet for magnetic sensors operate in 100~3000 K, as the magnetic susceptibility is closer to the transition point (2242 K) between para-magnetism and diamagnetism, the correlation of magnetic susceptibility to temperature is linear.

6. Sixth Embodiment (—NbC)

When the cermet for magnetic sensors operate in 100~3000 K, as the magnetic susceptibility is closer to the transition point (5860 K) between para-magnetism and diamagnetism, the correlation of magnetic susceptibility to temperature is linear.

7. Seventh Embodiment (—TaC)

When the cermet for magnetic sensors operate in 100~3000 K, as the magnetic susceptibility is closer to the transition point (6180 K) between para-magnetism and diamagnetism, the correlation of magnetic susceptibility to temperature is linear.

8. Eighth Embodiment (—WC)

When the cermet for magnetic sensors operate in 100~3000 K, as the magnetic susceptibility is closer to the transition point (4201 K) between para-magnetism and diamagnetism, the correlation of magnetic susceptibility to temperature is linear.

9. Ninth Embodiment (W)

When the cermet for magnetic sensors operate in 100~3000 K, as the magnetic susceptibility is closer to the transition point (8609 K) between para-magnetism and diamagnetism, the correlation of magnetic susceptibility to temperature is linear.

In addition, the following table lists parameters of magnetic susceptibility and characteristic temperatures of the cermets for magnetic sensors:

TABLE 1

Parameters of Magnetic Susceptibility and Temperatures

| | $C^{-1}$, ($K^{-1}$) | $\chi_0^{-1}$ | $-C/\chi_0$, ($K^{-1}$) | b, (K) | $\theta_P$, (K) | $\theta_\rho$, (K) |
|---|---|---|---|---|---|---|
| C7M1 | −21.15 | 5.79 | 2735 | 2.52 | −6.25 | −1.85 |
| -TiC | −2.83 | 2.95 | 10443 | 0.54 | −3.49 | −1.67 |
| -ZrC | −7.95 | 3.59 | 4521 | 1.86 | −7.29 | −2.1 |
| -HfC | −9.07 | 3.98 | 4351 | 2.11 | −7.79 | −2.49 |
| -VC | −30.51 | 6.79 | 2242 | 4.11 | −6.39 | −0.35 |
| -NbC | −5.47 | 3.19 | 5860 | 0.6 | −3.32 | −1.45 |
| -TaC | −4.8 | 2.96 | 6180 | 0.79 | −5.09 | −2.42 |
| -WC | −8.52 | 3.58 | 4201 | 1.09 | −5.47 | −2.43 |
| W | −1.18 | 1.02 | 8609 | 0.09 | −1.79 | −0.88 |

Figure 3A:
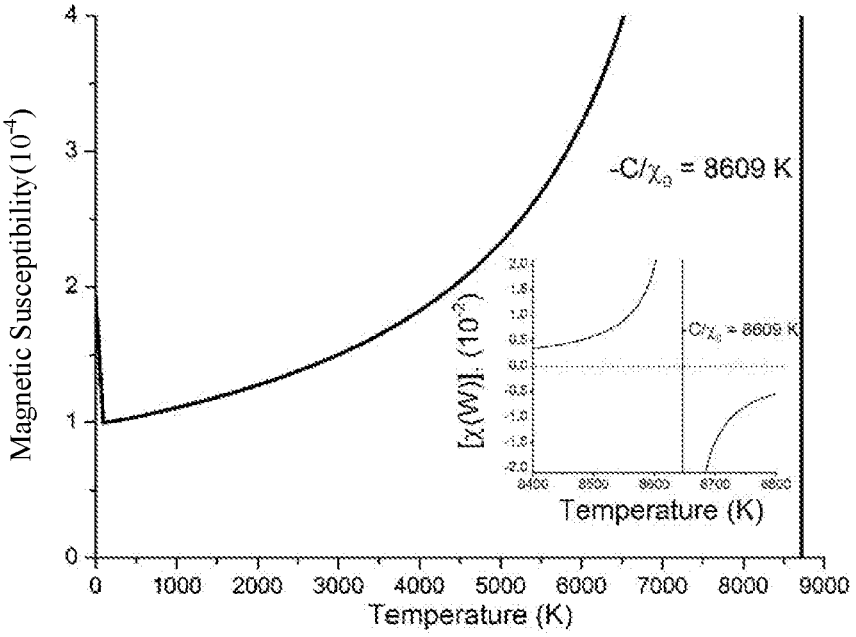
FIG. 3A is a schematic view of the correlation of magnetic susceptibility to temperature of the tungsten according to the cermet for magnetic sensors of the disclosure.
Figure 3B:
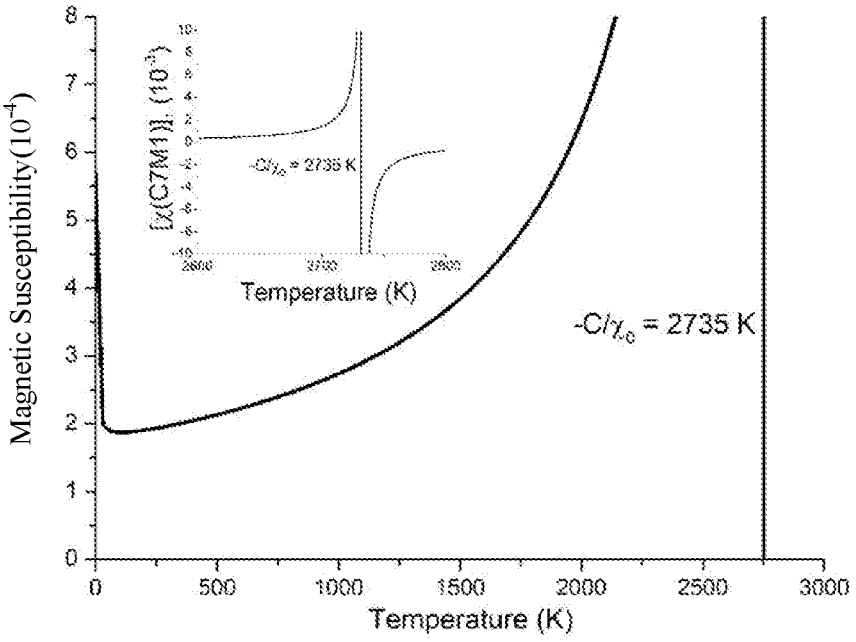
FIG. 3B is a schematic view of the correlation of magnetic susceptibility to temperature of the cermet for magnetic sensors according to the first embodiment of the disclosure.
Figure 3C:
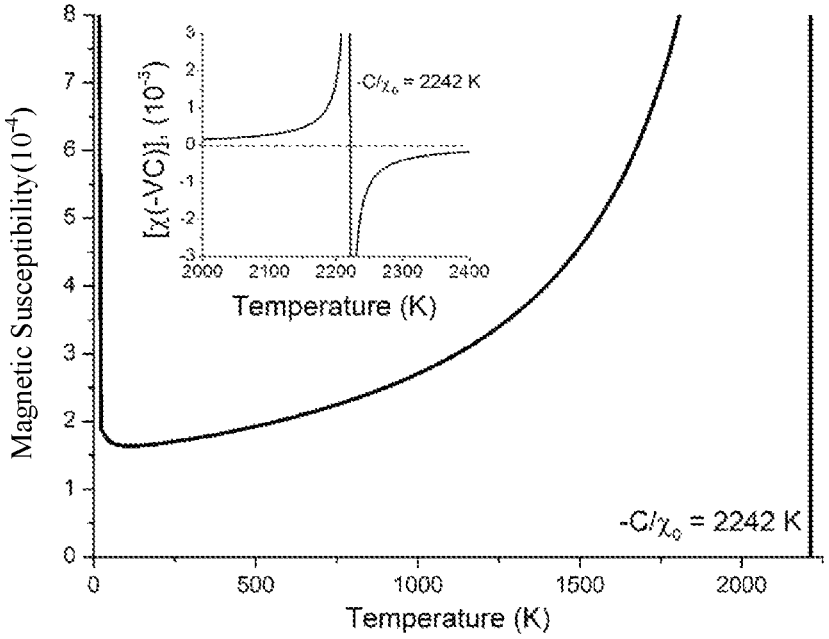
FIG. 3C is a schematic view of the correlation of magnetic susceptibility to temperature of the cermet for magnetic sensors according to the fifth embodiment of the disclosure.

According to Table 1, the transition point of the cermet for magnetic sensors between para-magnetism and diamagnetism (—$C/\chi_0$) is greater than 0 K, which can also be observed in FIG. 3A. However, the transition point (—$C/\chi_0$) of pure tungsten is as high as 8609 K, which is higher than the melting point of tungsten. In the disclosure, the first Embodiment (C7M1) and the fifth Embodiment (—VC) are selected. As shown in FIG. 3B, when the operation temperature of the cermet for magnetic sensors is higher than 2735 K, the cermet for magnetic sensors (C7M1) transforms from para-magnetic to diamagnetic states. As shown in FIG. 3C, when the operation temperature of the cermet for magnetic sensors is higher than 2300 K, the cermet for magnetic sensors (—VC) transforms from para-magnetic to diamagnetic. Thus, in the range of 2000~3000 K, the first embodiment (C7M1) and the fifth Embodiment (—VC) become diamagnetic, such that they have the chance of being superconducting materials. Therefore, the materials may have characteristics of superconducting materials between 2000~3000 K.

According to the disclosure, as compared to traditional technologies, the cermet for magnetic sensors of the disclosure has the following advantages:

1. According to the disclosure, the material is prepared by smelting, and when the magnetic susceptibility of the smelted material is closer to the transition point between para-magnetism and diamagnetism, the correlation of magnetic susceptibility to temperature is linear, such that the disclosure is suitable for the magnetic sensors operating at high temperatures.

2. According to the disclosure, certain embodiments have characteristics of superconducting materials between 2000~3000 K.

3. According to the smelted cermet for magnetic sensors of the disclosure, the para-magnetic Curie point is higher than the ferromagnetic Curie point while the para-magnetic Curie point is lower than the ferromagnetic Curie point for traditional ferromagnetic materials, which indicates the significant difference between the disclosure and traditional ferromagnetic materials.

4. According to the smelted cermet for magnetic sensors of the disclosure, C is negative while C of traditional ferromagnetic materials is positive, which indicates the significant difference between the disclosure and traditional ferromagnetic materials.

Note that the specifications relating to the above embodiments should be construed as exemplary rather than as limitative of the present disclosure. The equivalent variations and modifications on the structures or the process by reference to the specification and the drawings of the disclosure, or application to the other relevant technology fields directly or indirectly should be construed similarly as falling within the protection scope of the disclosure.

What is claimed is:

1. Cermets for magnetic sensors, comprising at least six carbides and at least one refractory metal, wherein the carbides are selected from TiC, VC, ZrC, HfC, WC, NbC and TaC, the refractory metal is tungsten, the cermets for magnetic sensors operates in 100~3000 K, and the magnetic precision is between 99.6~99.9%.

2. The cermets for magnetic sensors according to claim 1, wherein a transition point of the cermets for magnetic sensors between para-magnetism and diamagnetism is greater than 0 K.

3. The cermets for magnetic sensors according to claim 1, wherein the carbides comprise TiC, ZrC, HfC, WC, NbC and TaC, and when an operation temperature of the cermet for magnetic sensors is higher than 2300 K, the cermet for magnetic sensors transform from para-magnetic to diamagnetic states.

4. The cermet for magnetic sensors according to claim 1, wherein the carbides comprise TiC, VC, ZrC, HfC, WC, NbC and TaC, and when an operation temperature of the cermet for magnetic sensors is higher than 2800 K, the cermet for magnetic sensors transforms from para-magnetic to diamagnetic.

5. The cermet for magnetic sensors according to claim 1, wherein when the magnetic susceptibility of the cermet for magnetic sensors is closer to the transition point between para-magnetism and diamagnetism, the correlation of magnetic susceptibility to temperature is linear.

6. The cermet for magnetic sensors according to claim 1, wherein the paramagnetic Curie point of the cermet for magnetic sensors is higher than the ferromagnetic Curie point of the cermet for magnetic sensors.

* * * * *